US005155937A

United States Patent [19]

Yamagishi et al.

[11] Patent Number: 5,155,937

[45] Date of Patent: * Oct. 20, 1992

[54] AUTOMOTIVE SLIDE DOOR OPERATING SYSTEM WITH HALF-LATCH AND FULL-LATCH DETECTING DEVICE

[75] Inventors: Jun Yamagishi; Kouichi Shiota, both of Yokohama, Japan

[73] Assignee: Ohi Seisakusho Co., Ltd., Yokohama, Japan

[ * ] Notice: The portion of the term of this patent subsequent to May 28, 2008 has been disclaimed.

[21] Appl. No.: 659,576

[22] Filed: Feb. 22, 1991

[30] Foreign Application Priority Data

Feb. 23, 1990 [JP] Japan ..... 2-16824[U]

[51] Int. Cl.[5] ..... E05F 15/00

[52] U.S. Cl. ..... 49/280; 49/360

[58] Field of Search ..... 49/360, 324, 280, 29

[56] References Cited

U.S. PATENT DOCUMENTS

| | | | |
|---|---|---|---|
| 4,365,250 | 12/1982 | Matsudka et al. | 49/31 X |
| 4,496,942 | 1/1985 | Matsuoka | 49/25 X |
| 4,530,185 | 7/1985 | Moriya et al. | 49/280 |
| 4,617,757 | 10/1986 | Kagiyama et al. | 49/360 X |
| 4,634,945 | 1/1987 | Takemura et al. | 49/28 X |
| 4,640,050 | 2/1987 | Yamagishi et al. | 49/360 X |
| 4,848,031 | 7/1989 | Yamigishi et al. | 49/324 X |
| 4,968,074 | 11/1990 | Yamagishi et al. . | |
| 4,983,896 | 1/1991 | Sugiyama et al. | 49/26 X |
| 4,984,385 | 1/1991 | DeLand | 49/360 X |
| 5,018,303 | 5/1991 | Koura et al. | 49/280 |

FOREIGN PATENT DOCUMENTS

| | | |
|---|---|---|
| 58-178778 | 10/1983 | Japan . |
| 1-164647 | 6/1989 | Japan . |

*Primary Examiner*—Renee S. Luebke
*Assistant Examiner*—Jerry Redman
*Attorney, Agent, or Firm*—Foley & Lardner

[57] ABSTRACT

A half-latch and full-latch detecting device for an automotive slide door operating system is shown, which comprises:

a power feeding start position detecting switch which becomes operated when the door under closing movement comes to a given position just before a half-latch position of the door at which half-latch position a latch plate of a door lock device assumes a half-latch position;

a latch plate position detecting switch having a probe which is contactable with an open lever when the open lever is pivotally moved, the open lever being rotatable with a latch pawl which can latch the latch pawl at the half-latch and full-latch positions;

a counter circuit electrically connected to both the power feeding start position detecting switch and the latch plate position detecting switch, the counter circuit counting the number of times by which the open lever contacts the probe of the latch plate position detecting switch after the power feeding start position detecting switch is operated; and a judging circuit for judging that the latch plate assumes the half-latch position when the counter circuit counts the number "one" and judging that the latch plate assumes the full-latch position when the counter circuit counts the number "two".

6 Claims, 4 Drawing Sheets

DOOR-MOUNTED CONTROL UNIT
41
SECOND CONTROL CKT
48
THIRD CONTROL CKT
49
T2
T3
COUNTING CKT
N
M
R
C2
26a
26b
36
38
C1
25a
25b
BODY-MOUNTED CONTROL UNIT
40
FIRST FEEDING CKT
44
SECOND FEEDING CKT
45
TIMER
T1
BATTERY
24
P.F.P.D. SW.
20

AUTOMOTIVE SLIDE DOOR OPERATING SYSTEM WITH HALF-LATCH AND FULL-LATCH DETECTING DEVICE

BACKGROUND OF THE INVENTION

1. Field of the Invention

The present invention relates in general to slide door operating systems for a motor vehicle, and more particularly, to automotive slide door operating systems of a type in which when, under closing movement, the slide door comes to a so-called "half-latch position", a latch plate of a door lock device is forced to turn to its full-latch position thereby to forcedly shift the door to a so-called "full-close latched position". More specifically, the present invention is concerned with a detecting device which detects the half-latch and full-latch conditions of the door lock device.

2. Description of the Prior Art

In order to clarify the task of the present invention, some of the conventional slide door operating systems of the above-mentioned type will be described.

One of them is a system disclosed in Japanese Patent First Provisional Publication No. 58-178778. In this system, there are employed two limit switches installed in a door lock device, one being used for detecting the half-latch condition of the door lock device and the other being used for detecting the full-latch condition of the same. That is, when a latch plate of the door lock device is turned to the half-latch position, the latch plate actuates one switch, and when the latch plate is turned to the full-latch position, the latch plate actuates the other switch.

Japanese Patent First Provisional Publication No. 1-164647 shows another conventional door operating system. In this system, a power feeding connector is employed, which, when the door comes to a given position close to the full-closed position, establishes an electric connection between an electric power source mounted on the vehicle body and electric devices installed in the door. A half-latch detecting switch is mounted to the connector, which is actuated when the door comes to a half-latch position wherein the door lock device on the door assumes the half-latch condition. A full-latch detecting switch is arranged near the door lock device, which is actuated by a close lever when the latter is pivoted to a given position due to forced turning of the latch plate of the door lock device to the full-latch position.

However, since the above-mentioned conventional systems each use two switches for respectively detecting the half-latch and full-latch conditions or positions, not only the number of parts used increases but also wiring of the switches becomes complicated. Furthermore, it is necessary to provide the door and/or vehicle body with two mounting spaces for mounting the switches therein.

SUMMARY OF THE INVENTION

It is therefore an object of the present invention to provide an automotive slide door operating system which uses only one switch for detecting both the half-latch and full-latch conditions of an associated door lock device.

According to the present invention, there is provided a slide door operating system for use in a motor vehicle having a vehicle body and a slide door. The system comprises a door lock device mounted on the door and including a pivotal latch plate and a pivotal pawl which can latch the latch plate, the latch plate having a release position, a half-latch position and a full-latch position, the release position inducing a condition in which the door is released from the vehicle body, the half-latch position inducing a condition wherein the door is halfly latched by the vehicle body and the full-latch position inducing a condition wherein the door is fully latched by the vehicle body; an open lever secured to the pawl to pivot therewith; and a half-latch and full-latch detecting device including: power feeding start position detecting switch which becomes operated when the door under closing movement comes to a given position just before the half-latch position of the door at which half-latch position the latch plate assumes the half-latch position; a latch plate position detecting switch having a probe which is contactable with the open lever when the open lever is pivotally moved; counter means electrically connected to both the power feeding start position detecting switch and the latch plate position detecting switch, the counter means counting the number of times by which the open lever contacts the probe of the latch plate position detecting switch after the power feeding start position detecting switch is operated; and judging means for judging that the latch plate assumes the half-latch position when the counter means counts the number "one" and judging that the latch plate assumes the full-latch position when the counter means counts the number "two".

BRIEF DESCRIPTION OF THE INVENTION

Other objects and advantages of the present invention will become apparent from the following description when taken in conjunction with the accompanying drawings, in which:

FIG. 1 is a perspective view of a power slide door of a motor vehicle, to which the present invention is applied;

FIG. 2*a* and 2*b* block diagrams of a control circuit employed in an operating system of the power slide door;

FIG. 3 is a flowchart showing operation steps which are carried out in a computer employed in the control circuit; and FIGS. 4*a*, 4*b* and 4*c* show the latch plate and latch pawl interface as viewed along arrow F of FIG. 1 in the released, half-latched and full-latched conditions respectively.

DETAILED DESCRIPTION OF THE INVENTION

In the following, an embodiment of the present invention will be described in detail with reference to the attached drawings.

As will become apparent as the description proceeds, the embodiment is described with respect to a power slide door of a motor vehicle.

Figure 1:
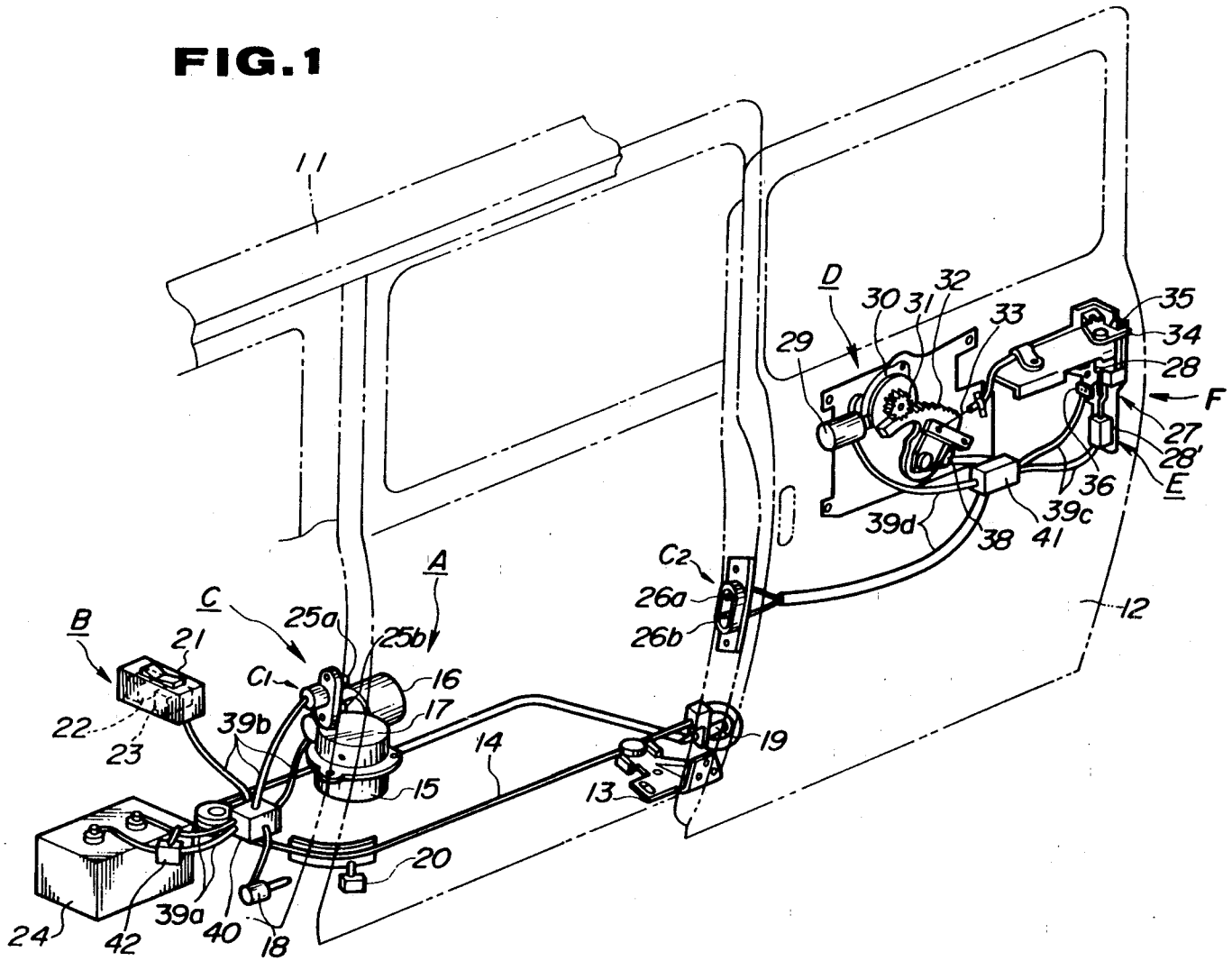
Figures 2A, 2B:
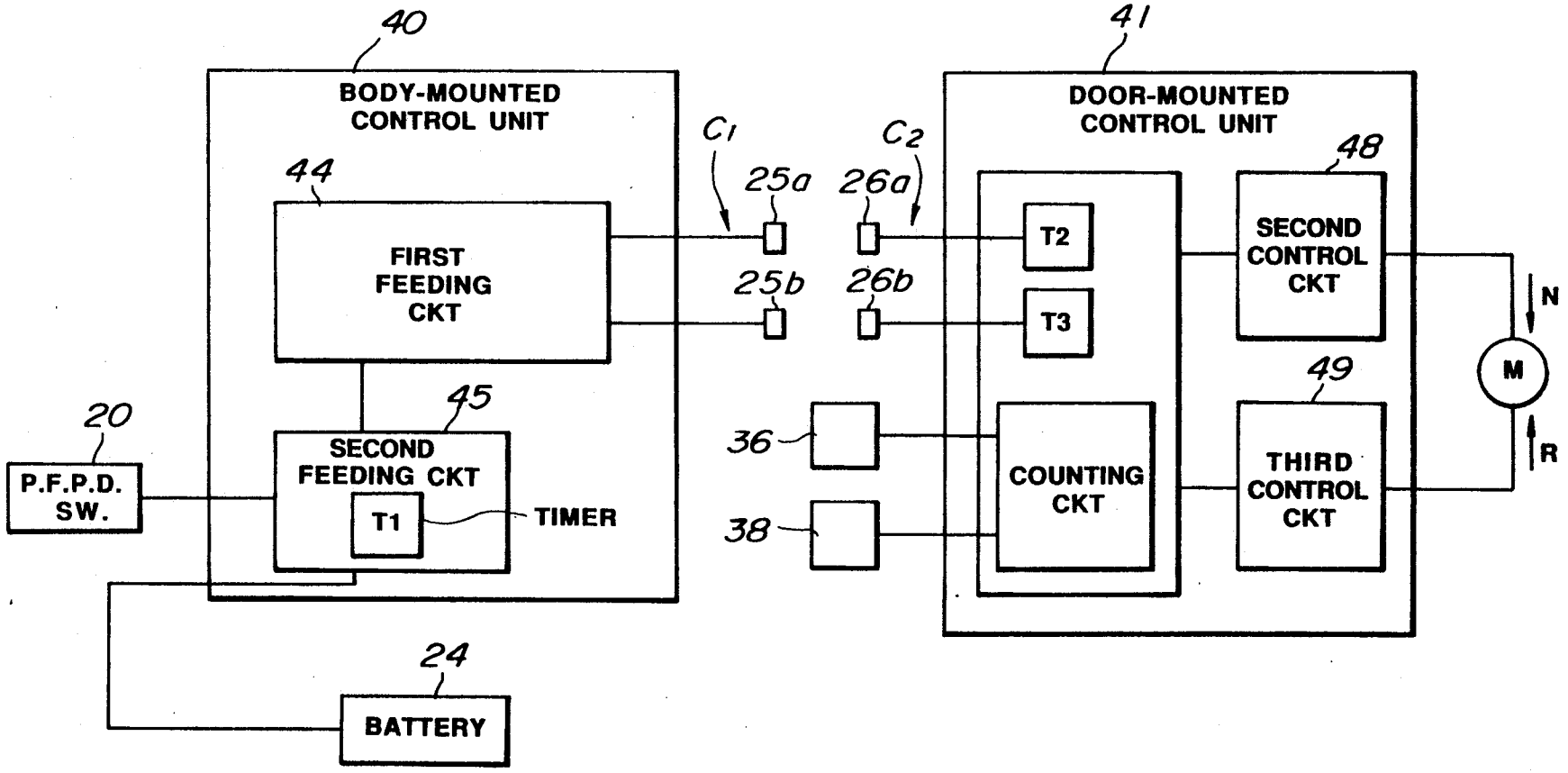

Referring to FIG. 1, there is shown a power slide door of a motor vehicle, to which the present invention is practically applied.

In the drawing, denoted by numeral 11 is a vehicle body, and denoted by numeral 12 is a slide door. Although not shown in the drawing, a known door guide structure is employed by which a guide way for the door 12 is defined. That is, upon starting of the door opening operation, the door 12 which is in a full-close position is shifted laterally outward and then moved rearward toward a full-open position. The movement of the door 12 from the full-open position to the full-close position is carried out by travelling the same way in a reversed fashion.

As is shown in the drawing, at a lower portion of the vehicle body 11, there is arranged a door moving device "A" by which the door 12 is driven between the full-close position (more specifically, a position very near the full-close position) and the full-open position along the guide way defined by the door guide structure.

The door moving device "A" comprises a bracket 13 which is secured to a lower front portion of the door 12. The bracket 13 has a drive cable 14 fixed thereto, the cable having a linear part which extends along the guide way for the door 12. The cable 14 has both end portions wound around a drive drum 15 which is driven by a reversible electric motor 16 through a speed reduction gear 17. Thus, upon energization of the motor 16, the drive drum 15 is rotated in one or the other direction to move the slide door 12 in the opening or closing direction along the door guide way.

The door moving device "A" is controlled by a door close detecting switch 18 and a door-open detecting switch 19. The door close detecting switch 18 is of a normally closed type, which is mounted on the vehicle body 11 and turned OFF when the door 12 comes to the full-close position. For this operation, the switch 18 has an antenna pin which is contactable with a front end of the door 12. The door-open detecting switch 19 is of a normally open type, which is mounted on the vehicle body 11 and turned ON when the door 12 comes to the full-open position. Similar to the switch 18, the switch 19 has an antenna pin which is contactable with a rear end of the bracket 13 of the door 12.

It is to be noted that the door 12 can be moved by manual labor. That is, with the automatic door operating system is inoperative, the door 12 is manually moved, the drive cable 14 is moved and thus a rotor of the electric motor 16 is forced to rotate via the drive drum 15 and the speed reduction gear 17.

The vehicle body 11 has a so-called "power feeding start position detecting switch" 20 mounted thereto. The switch 20 is of a normally open type and so constructed as to close for a moment only when the front end of the slide door 12, during its closing movement, passes by a so-called "power feeding start position" which is near an after-mentioned "half-latch" position.

It is to be noted that when the door 12 takes the power feeding start position, there is defined a small clearance between the front end of the door 12 and a front end of the door opening, which clearance is so sized as not to permit insertion of an operator's hand thereinto. More specifically, the clearance is somewhat larger than a clearance which is defined when the door 12 assumes the half-latch position.

Designated by reference "B" is a control device which is mounted on the vehicle body 11 at a position near the driver's seat or near the door opening of the vehicle body 11. The control device "B" comprises a seesaw type button switch 21.

The button switch 21 comprises one movable contact and two stationary contacts. The movable contact and one stationary contact constitute a so-called "door opening control switch" 22, while, the movable contact and the other stationary contact constitute a so-called "door closing control switch" 23. That is, when the button is pivoted in one direction, the switch 22 is closed opening the other switch 23, while, when the button is pivoted in the other direction, the switch 23 is closed opening the other switch 22.

Designated by numeral 24 is a battery, serving as an electric power source, which is mounted on the vehicle body 11.

Designated by reference "C" is an electric connector which comprises mutually engageable first and second connector parts C1 and C2 each of which include two axially movable contact pins **25*a* and 25*b* (or, 26*a* and 26*b***). Each contact pin is biased to project outward by a spring associated therewith.

The first connector part C1 is mounted on a front end (more particularly, a pillar portion bordering the front periphery) of the door opening having the contact pins **25*a* and 25*b* directed rearward and the second connector C2 is mounted on the front end of the slide door 12 having the contact pins 26*a* and 26*b*** directed forward.

The first and second connector parts C1 and C2 become engaged to establish an electrical connection therebetween when the door 12 closes. More specifically, when the slide door 12 assumes a position between the power feeding start position and the full-close position, the contact pins **25*a* and 25*b* of the first connector part C1 and the contact pins 26*a* and 26*b* of the second connector part C2 are mated. Thus, under this condition, electric power feeding from the battery 24 to the after-mentioned electric devices in the slide door 12** is available.

The contact pins **25*a* and 25*b* of the first connector part C1, the motor 16, the door-close detecting switch 18, the door-open detecting switch 19, the control device "B", the power feeding start position detecting switch 20 and the battery 24 are connected through lead wires 39*a* and 39*b* to a body-mounted control unit 40** which will be described hereinafter.

Within the door 12, there is mounted a latch cancelling device "E" which, upon electric energization, cancels the latched condition of the slide door 12 in the full-close latched position. For achieving this latch cancellation, the device "E" has an open lever 28 incorporated with the door lock device 27 and a solenoid-spring combination type actuator 28' which is incorporated with the open lever 28. That is, upon energization of the actuator 28', the open lever 28 is pulled in a direction to cancel the latched condition of the door lock device 27. Upon this, the slide door 12 becomes unlatched and thus, thereafter, the opening movement of the door 12 is available.

Within the door 12, there is further mounted a door closing device "D" which is described in U.S. Pat. No. 4,968,074 granted to Jun YAMAGISHI on Nov. 6, 1990.

The door closing device "D" comprises a reversible electric motor 29, a speed reduction gear 30 driven by the motor 29, a pinion 31 driven by an output shaft of the speed reduction gear 30 and a sector gear 32 meshed with and thus driven by the pinion 31.

When the motor 29 is energized to run in a normal direction, the sector gear 32 pivots in a counterclockwise direction in FIG. 1 thereby pulling a cable 33 which connects the sector gear 32 with a close lever 34. With this movement, the close lever 34 is pivoted in one direction to turn the latch plate 50 of the door lock device 27 to the full-latch position. Because the latch plate is in engagement with a body-fixed striker (not shown), the pivoting movement of the latch plate to the full-latch position induces a shifting of the slide door 12 from the half-latch position to the full-close latched position.

Designated by numeral 35 is an arm possessed by the latch plate 50, against which the close lever 34 abuts for the movement of the latch plate.

When, thereafter, the motor 29 is energized to run in the other direction, the sector gear 32 and thus the close lever 34 are moved in the other direction, and finally, they are returned to their original rest positions, as is understood from FIG. 1. The close lever 34 stops at a position remote from the arm 35 of the latch plate. It is to be noted that during this movement, the full-close latched condition of the door 12 is kept unchanged.

Thus, the sector gear 32, the cable 33 and the close lever 34 constitute a so-called "latch plate actuating means".

Designated by numeral 36 is a latch plate position detecting switch which is mounted on the door lock device 27 to detect both the half-latch and full-latch conditions of the latch plate 50 of the door lock device 27. For this detection, the switch 36 has a so-called "probe" against which the open lever 28 of the door lock device 27 abuts "twice" when the latch plate 50 of the door lock device 27 is turned from its free position to the full-latch position through the half-latch position.

That is, as is known, when the latch plate is not in engagement with the striker, the latch plate 50 contacts a stopper (not shown) keeping the free position.

When the door 12, under closing movement, comes to a position just before the half-latch position of the same, the latch plate 50 is brought into abutment with the striker and thus turned slightly in a direction toward the full-latch position. With this slight turning of the latch plate 50, one pawl portion of the latch plate is brought into contact with a latch pawl 51 integral with the open lever 28 thereby slightly turning the open lever 28 in the direction to cancel the latched condition of the door lock device 27. This slight turning of the open lever 28 includes a first abutment against the "probe" of the switch 36. When thereafter the door 12 comes to a position just before the full-close latched position, the other pawl portion of the latch plate is brought into contact with the latch pawl thereby slightly turning the open lever 28 in the direction to cancel the latched condition of the door lock device 27. This slight turning of the opening lever 28 induces a second abutment against the "probe" of the switch 36. It is to be noted that the first and second abutments of the open lever 28 against the probe allow the switch 36 to detect the half-latch and full-latch conditions of the latch plate of the door lock device 27.

Designated by numeral 38 is a so-called "return recognition switch" which detects whether the sector gear 32 has returned to the rest position or not. The switch 38 is kept OFF when the sector gear 32 is at the rest position as shown in FIG. 1, but turned ON when the sector gear 32 is pivoted away from the rest position.

The motor 29, the latch plate position detecting switch 36, the return recognition switch 38 and the actuator "E" are connected through suitable lead wires **39*c* to a door-mounted control unit 41. The contact pins 26*a* and 26*b* of the second connector part C2 are connected to the control unit 41 through lead wires 39*d***, as shown.

FIGS. **2*a* and 2*b* are block diagrams showing only circuits of a control system 43**, which control the door closing device "D".

The control system 43 comprises generally the body-mounted control unit 40 and the door-mounted control unit 41.

The body-mounted control unit 40 comprises a first feeding circuit 44 which is connected to the contact pins **25*a* and 25*b* of the first connector part C1, and a second feeding circuit 45 which is connected to the battery 24, the first feeding circuit 44 and the feeding start position detecting switch 20**.

The second feeding circuit 45 includes a timer "T1" which is arranged to start time counting when the feeding start position detecting switch 20 operates due to arrival of the slide door 12, under closing movement, at the feeding start position. That is, upon operation of the switch 20, the timer T1 starts the counting of the time for which the first feeding circuit 44 is kept operated. That is, the operation of the first feeding circuit 44 is maintained for a time determined by the timer T1.

When the first feeding circuit 44 is operated by the second feeding circuit 45, the power feeding from the circuit 44 toward the first connector part C1 is made that the contact pins **25*a* and 25*b* are charged positive and negative respectively. The detail of the first feeding circuit 44** is substantially disclosed in U.S. Patent application No. 07/526,653, now U.S. Pat. No. 5,018,303 in the names of Soushichi KOURA et al.

The door-mounted control unit 41 comprises a first control circuit 47 which is connected to the contact pins **26*a*, 26*b* of the second connector part C2, the latch plate position detecting switch 36 and the return recognition switch 38, a second control circuit 48 which is connected to the first control circuit 47 and the motor 29 of the door closing device "D" for allowing the motor 29 to run in a normal direction, and a third control circuit 49 which is arranged to operate the motor 29** to run in a reversed direction.

These circuits 47, 48 and 49 may be arranged in substantially the same manner as is described in the U.S. Patent application No. 07/526,653, now U.S. Pat. No. 5,018,303. In fact, as will be described hereinafter, in the present invention, a so-called "counter circuit" 50, and timers T2 and T3 are incorporated with such circuits.

The first control circuit 47 comprises the counter circuit 50.

The counter circuit 50 functions to count the number of times of operation of the latch plate position detecting switch 36 from the time when, due to the electric connection of the first and second connector parts C1 and C2 because of the closing movement of the slide door 12 to a given position, the contact pins **25*a* and 25*b* are charged positive and negative respectively as is described hereinabove. At the time, due to the arrival of the door 12 at the given position, the power feeding start position detecting switch 20** starts to operate.

More specifically, the counter circuit 50 counts the number of times by which the open lever 28 contacts the probe of the latch plate position detecting switch 36 after the time when the power feeding start position detecting switch 20 is turned ON.

When the slide door 12 comes to the half-latch position, the counter circuit 50 counts the first operation of the latch plate position detecting switch 36 and thus detects that the latch plate has taken the half-latch position. When thereafter the slide door 12 comes to the full-close position, the counter circuit 50 counts the second operation of the latch plate position detecting switch 36 and thus detects that the latch plate has taken the full-latch position. The information signals from the switch 36 are fed to the first control circuit 47. The counter circuit 50 thus has a so-called "judging means" which judges that the latch plate assumes the half-latch position when the counter means counts the first operation of the switch 36 and judges that the latch plate assumes the full-latch position when the counter means counts the second operation of the switch 36.

The counter circuit 50 may be constructed of an integrated circuit (IC) for counter, a flip-flop circuit or the like.

The first control circuit 47 functions as follows.

When, after starting of the power feeding to the door-mounted electric parts, the first information signal is issued from the counter circuit 50, the first control circuit 47 energizes the second control circuit 48 thereby running the motor 29 in the normal direction, and when, thereafter due to the arrival of the door 12 at the full-close position, the second information signal is issued from the counter circuit 50, the first control circuit 47 deenergizes the second control circuit 48 and at the same time energizes the third control circuit 49 thereby running the motor 29 in the reverse direction. subsequently when the return recognition switch 38 detects that the sector gear 32 has returned to the rest position, the first control circuit 47 deenergizes the third control circuit 49 which thereby stops the motor 29.

The timer T2 is so set as to stop the running of the motor 29 in the normal direction when the latch plate position detecting switch 36 fails to make the second operation within a given time from the time when the switch 36 makes the first operation.

The other timer T3 is so set as to stop the running of the motor 29 in the reverse direction when the return recognition switch 38 fails to operate within a o given time from the time when the switch 36 makes the second operation.

Figure 3:
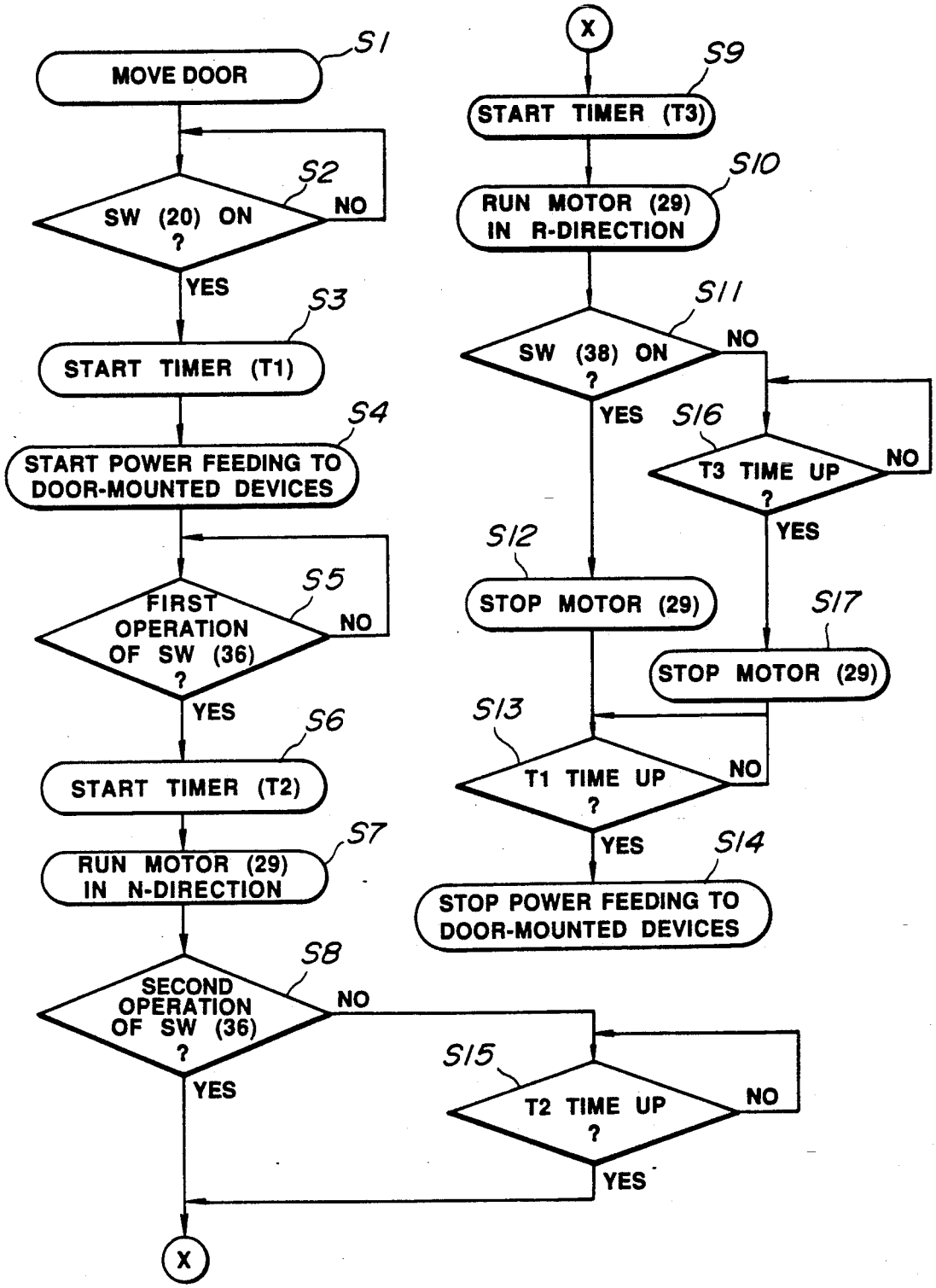
Figure 4C:
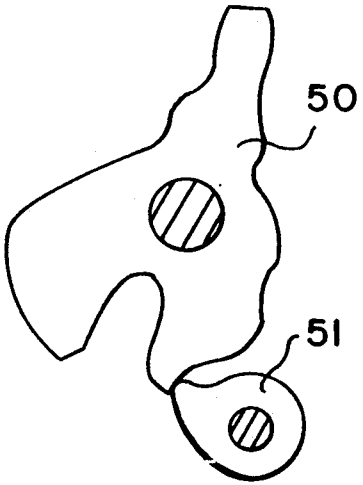
Figure 4B:
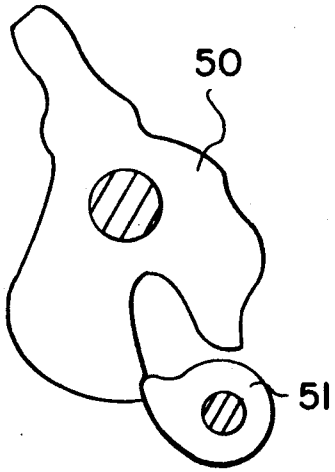
Figure 4A:
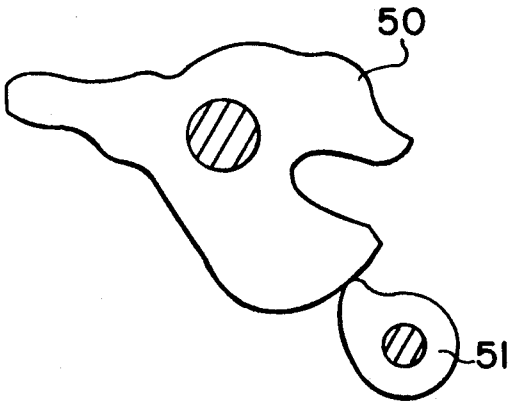

In the following, operation of the door closing device "D" will be described with reference to the flowchart shown in FIG. 3.

For ease of understanding, the description will be commenced with respect to a condition wherein the slide door 12 is open.

When the control device "B" is manipulated to close the door closing control switch 23, the door moving device "A" moves the door 12 in a closing direction (Step 1).

When, during the closing movement of the door 12, the door 12 comes to a position where the first and second connector parts C1 and C2 are operatively coupled and comes to the power feeding position to turn the feeding start position detecting switch 20 ON (Step 2), the timer "T1" starts to count the time (Step 3) and at the same time, power feeding to the door-mounted electric devices starts (Step 4).

When, thereafter, the door 12 comes to the half-latch position and the half-latch plate position detecting switch 36 is subjected to the first abutment against the open lever 28 and turned ON (Step 5), the timer T2 starts the time counting (Step 6) and at the same time, the motor 29 of the door closing device "D" is energized to run in the normal direction (Step 7).

With this, due to the operation of the door closing device "D", the latch plate is forced to turn toward the full-latch position thereby to forcedly shift the door 12 toward the full-close latched position.

When, within the time given by the timer T2 (viz., during the running of the motor 29 in the normal direction), the latch plate is turned to the full-latch position (viz., the door 12 is shifted to the full-close latched position) and thus the open lever 28 is subjected to the second abutment against the latch plate position detecting switch 36 (Step 8), the timer T3 starts the time counting (Step 9). Thus, when the motor 29 stops running in the normal direction, the motor 29 is reenergized to run in the reverse direction (Step 10).

With the running of the motor 29 in the reverse direction, the sector gear 32 and the close lever 34 are turned toward their rest positions.

When, within the time given by the timer T3 thereafter, the sector gear 32 is returned to the rest position turning the return recognition switch 38 ON (Step 11), the reversed running of the motor 29 stopped (Step 12).

When, thereafter, the time determined by the timer T3 elapses (Step 13), the power feeding to the door-mounted devices is stopped (Step 14).

When, at Step 8, the time determined by the timer T2 elapses (Step 15) before the open lever 28 makes the second abutment against the latch plate position detecting switch 36, the operation step is returned to Step 9 to actuate the timer T3 and the motor 29 is energized to run in the reverse direction (Step 10).

When, at Step 11, the return recognition switch 38 fails to operate due to some reasons, the elapse (Step 16) of the time determined by the timer T3 stops the reverse rotation of the motor 29 (Step 17). Accordingly, undesired continuous running of the motor 29 is suppressed.

What is claimed is:

1. A slide door operating system for use in a motor vehicle having a vehicle body and a slide door, comprising:

a door lock device mounted on said door and including a pivotal latch plate and a pivotal latch pawl which can latch said latch plate, said latch plate having a release position, a half-latch position and a full-latch position, said release position inducing a condition in which said door is released from the vehicle body, said half-latch position including a condition wherein said door is halfly latched by said vehicle body and said full-latch position inducing a condition wherein said door is fully latched by said vehicle body;

an open lever secured to said latch pawl to pivot therewith; and a half-latch and full-latch detecting device including:

a power feeding start position detecting switch which becomes operational when said door under closing movement comes to a given position just before the half-latch position of the door at which half-latch position said latch plate assumes said half-latch position;

a latch plate position detecting switch having a probe which contacts said open lever when said open lever is pivotally moved;

counter means electrically connected to both said power feeding start position detecting switch and said latch plate position detecting switch, said counter means counting the number of times by which said open lever contacts said probe of said latch plate position detecting switch after said power feeding start position detecting switch is operated; and judging means for judging that the latch plate assumes said half-latch position when said counter means counts the number "one" and judging that the latch plate assumes said full-latch position when said counter means counts the number "two".

2. A slide door operating system as claimed in claim 1, wherein said latch plate position detecting switch is arranged so that the contact of said probe with said open lever takes place when said latch pawl is pivoted in a direction to cancel the latched condition of said latch plate.

3. A slide door operating system as claimed in claim 2, further comprising a door closing device mounted on said door, said device including:

an electric motor incorporated with said half-latch and full-latch detecting device, said electric motor being energized to run in one direction when said judging means judges that the latch plate assumes the half-latch position; and a latch plate actuating means which forcedly turns said latch plate in a direction to achieve the full-latch position of the latch plate when said electric motor runs in said one direction.

4. A slide door operating system as claimed in claim 3, further comprising:

means for energizing said electric motor to run in another direction when said door comes to its full-latch position; and a return recognition switch which detects a rest position of said door closing device; and means for deenergizing said electric motor when said return recognition switch detects the rest position of said door closing device.

5. A slide door operating system as claimed in claim 4, further comprising:

first timer means which stops the energization of said electric motor when said counter means fails to count the number "two" within a given time from the time when said counter means counts the number "one"; and second timer means which stops the energization of said electric motor when said return recognition switch fails to detect the rest position of said door closing device within a given time from when said counter means counts the number "two".

6. A slide door operating system as claimed in claim 5, further comprising unlatching means which pivots said latch pawl for said latch plate in a direction to cancel the latched position of said latch plate.

* * * * *